United States Patent [19]

Loverdi et al.

[11] Patent Number: 4,987,613

[45] Date of Patent: Jan. 29, 1991

[54] ALL-IN-ONE SLIDER SPORT PANTS

[76] Inventors: Angela M. Loverdi; Charles T. Loverdi, both of 117 Burton Rd. East, Sharon Hill, Pa. 19079

[21] Appl. No.: 473,613

[22] Filed: Feb. 1, 1990

[51] Int. Cl.[5] ..... A41D 13/00; A41D 13/06

[52] U.S. Cl. ..... 2/23; 2/22; 2/24; 2/227; 2/267

[58] Field of Search ..... 2/2, 22, 23, 24, 227, 2/267

[56] References Cited

U.S. PATENT DOCUMENTS

| | | | |
|---|---|---|---|
| 1,406,794 | 2/1922 | Whitley | 2/23 |
| 1,602,454 | 10/1926 | Riddell | 2/23 |
| 1,659,100 | 2/1928 | Hardage | 2/23 |
| 1,944,127 | 1/1934 | Jones | 2/23 |
| 4,091,466 | 5/1978 | Kearn | 2/23 |
| 4,292,263 | 9/1981 | Hanrahan et al. | 2/23 |
| 4,397,043 | 8/1983 | Croteau | 2/2 |
| 4,455,686 | 6/1984 | Zide | 2/23 |
| 4,479,269 | 10/1984 | Balliet | 2/23 |
| 4,700,407 | 10/1987 | Mattila | 2/23 |
| 4,894,867 | 1/1990 | Ceravolo | 2/23 |

*Primary Examiner*—Werner H. Schroeder
*Assistant Examiner*—G. Hale
*Attorney, Agent, or Firm*—Robert Charles Beam; James B. Bechtel

[57] ABSTRACT

An all-in-one slider sport pants is disclosed that protects the leg, thigh, hip and buttocks area of a softball player sliding into base. The pants can be made either in baseball-pants length, or in a shorter version, and have a thin, foam padding encircling substantially three-quarters of the player's thigh and leg and covering the hip area and most of the buttocks, sewn between layers of a double knit, polyester material. The waistband is constructed with a wider-than-normal elastic material and double snaps and zipped fly to give secure, yet comfortable, fit. The foam padding can be made of synthetic foam rubber or foam plastic and is sewn, using polyester thread and zig-zag stitching, in between the outer polyester layer and the inner layer at the waist band, the side seams and along longitudinal seams down both front and back sides of the legs to prevent slipping or bunching thereof during body movement or laundering.

10 Claims, 3 Drawing Sheets

ALL-IN-ONE SLIDER SPORT PANTS

BACKGROUND OF THE INVENTION

1. Field of the Invention

This invention is used by athletes playing sports such as softball or baseball. In particular, the invention is useful to protect the legs and hip areas of those athletes, as they slide into a base on the basepath.

2. Description of Related Art

Athletic endeavors that require the participant to be physically active, such as in running or jumping or bending, and that can involve contact between the ground and parts of the legs or hips, such as baseball, softball, soccer, lacrosse or football, are popular with all age groups. With such popularity comes the potential for bruises and scrapes whenever contact with the ground is made. Players know that they can take protective measures, that involve the player wearing padding or extra layers of clothing, and several U.S. Patents for such protective measures have been issued.

U.S. Pat. No. 981,024 to W. T. Stall, and entitled "Interior Detachable Pad For Garments" describes how football breeches can be configured to include internal strips provided with eyelets for fastening hip, thigh or knee pads thereto. The pads inserted at the legs may be a pair of smaller pads conveniently joined by sewing separate portions of padding material into woven covering material and the strips provided are positioned both along the waistband area and along the sides.

U.S. Pat. No. 3,170,163 to H. D. Mitchell and entitled "Football Uniform" shows a protective garment built to be worn by football players that integrates pants and shirt or jersey into a single, functional unit. This garment provides an elastic strap formation, or a pants supporter, that provides support for both the pants and hip pads only at the lateral sides of the wearer's body.

U.S. Pat. No. 4,700,407 to Heikki Mattila and entitled "Protective Garment" discloses a sports garment made with pockets that can be fitted with resilient shock-absorbing pads. These pads are fitted into the pockets formed in the basic garment and fastened to the garment in such a way that part of the layer protecting the person is formed solely by the pads. This invention also shows that protective pads can be positioned at any number of positions around the wearer's body.

Finally, U.S. Pat. No. 4,280,342 to Kjeal Eng, et al., and entitled "Protective Pad Or Garment For The Human Body Or Parts Thereof" shows that a garment can be made to have a protective pad that comprises two mesh layers interconnected by pile threads that will give protection from the blade of a power saw. When the teeth of the saw contact the pad, they will first tear up the outer layer at the point of impact and bend the pile threads underneath backwards. Although some of the pile threads are torn away or damaged, the operator will have time to escape therefrom before the teeth can penetrate through the inner layer.

This art shows means to protect body parts by providing thick or individually-placed padding at strategic spots on or in a garment when an especially violent force, such as the pounding from football contact or the ripping from a power saw accident, occurs. But in certain sports where, for instance, only a minimum amount of contact is expected, this style of garment is either too awkward or too heavy to be used. Until the instant invention, a lightweight, lightly-padded yet flexible, easily-washable, pant that can be worn by players running the basepath in a softball or baseball game has not been produced.

SUMMARY OF THE INVENTION

The All-In-One Slider Sports Pants is carefully constructed to provide protection to a softball or baseball player's hips, buttocks and legs by covering those areas with a triple layer garment that includes a sheet of foam padding sewn between outer and inner layers of a durable, yet easily-cleaned fabric. The outer layer, made from double-knit material, is formed into the shape of trousers, with or without a zipped, fly-front opening, and the foam padding layer and the inner layer are cut to substantially the same dimensions and sewn, using a zig-zag stitch, onto, and through, the inside surface of the outer layer. An elastic waistband and elastic leg-bands are sewn into their respective spots on the garment, along with the inner two layers, and the longitudinal, zig-zag stitching up and down the front and back of the leg portions further secures these layers against bunching or movement during actions by the player.

It is therefore an object of the present invention to provide sufficient protection for a player's legs and hips, both from friction between the ground and parts of the legs while the player is sliding, as well as from bruising when contact with the ground is first made at the start of a slide, while the player is engaged in the sport of softball or baseball.

It is a further object of the present invention to provide a protective garment with sufficient padding therein to protect the player yet be pliant enough so as not to interfere with lower body movements as the player participates in the softball or baseball activity.

It is a still further object of the present invention to provide a protective garment where the construction of the garment does not require bulky straps or fasteners to keep the padding securely in the proper position as the player moves about.

These and other objects of the present invention will become readily apparent from a reading of the specification and appended claims in view of the attached drawings.

DETAILED DESCRIPTION OF THE PREFERRED EMBODIMENT

Figure 5:
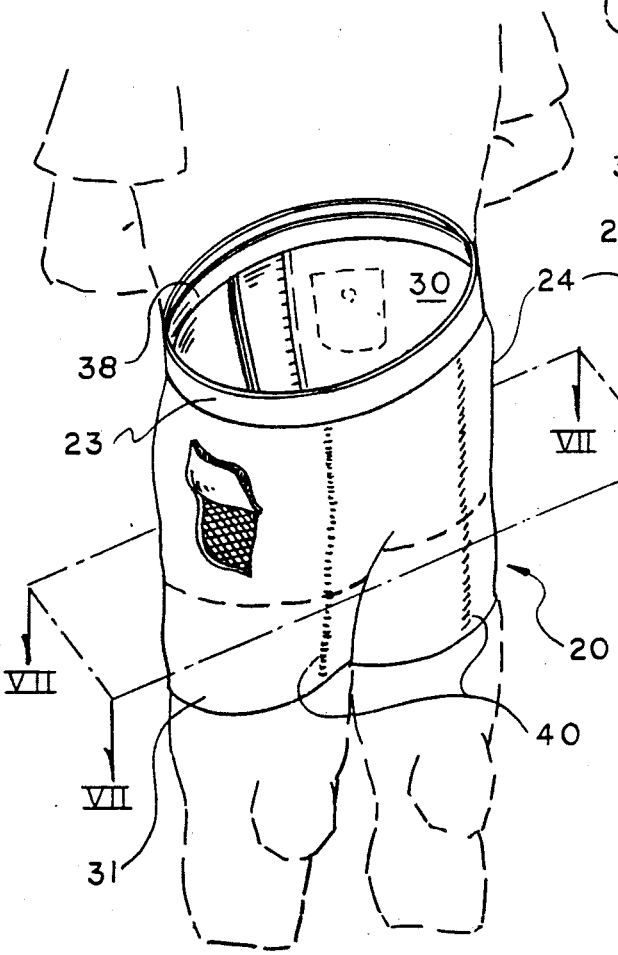
FIG. 5 shows a fragmentary, perspective view of the front of a player (shown in phantom) wearing an alternate embodiment of the instant invention.
Figure 6:
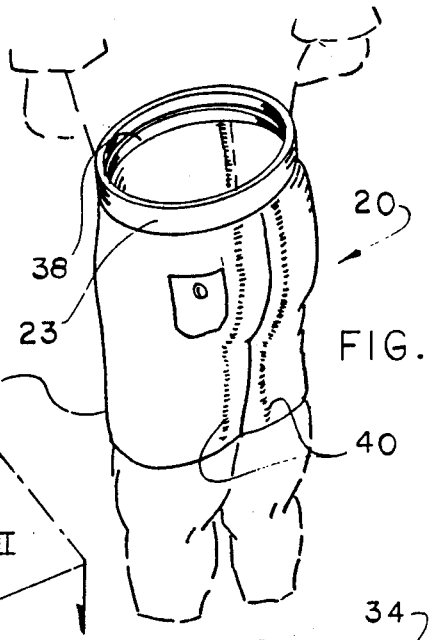
FIG. 6 shows a fragmentary, perspective view of the back of the player wearing the alternate embodiment shown in FIG. 5.
Figure 7:
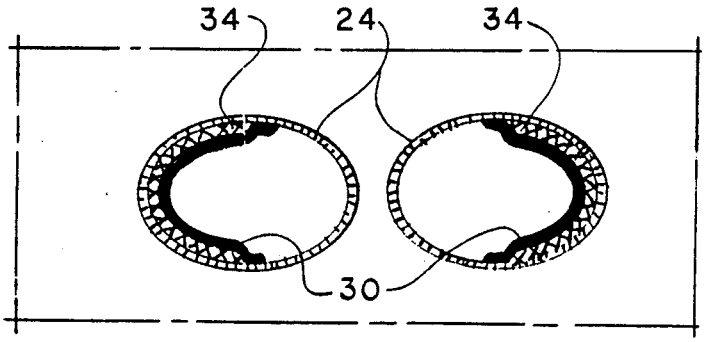
FIG. 7 shows a cross-sectional plan view of the alternate embodiment, as taken at VII—VII of FIG. 5.

The all-in-one slider 20 is designed to be worn by either softball or baseball players. The outer layer of the garment, either full-length 22 (as seen in FIGS. 1 to 4) or the short-length 24 (as seen in FIGS. 5 to 7), is made of any of the commonly used, wear-resistant materials, such as polyester/polyamide, polyamide/nylon or combinations thereof. The inner lining, that will be adjacent the player, can be made from any comfortable, yet durable, material, such as any of the above-described combinations or a polyester double-knit material, as is commonly known.

Figure 8:
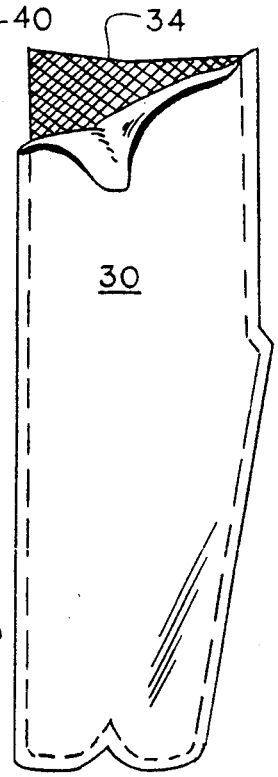
FIG. 8 shows an isolated, fragmentary and plan view of the inner two layers of the garment, as they would appear inside the garment of FIGS. 1 and 2; and, FIG. 9 shows an isolated, fragmentary and plan view of the inner two layers of the garment, as they would appear inside the garment of FIGS. 5 and 6.
Figure 3:
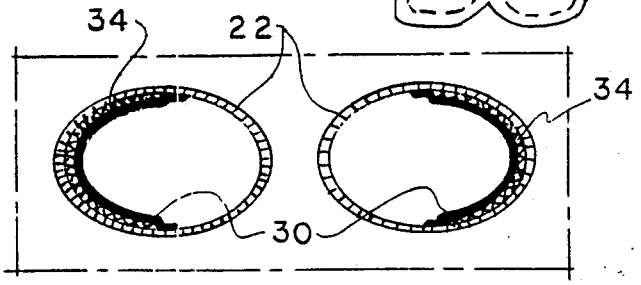
FIG. 3 shows a cross-sectional view of the pants taken at III—III of FIG. 1.
Figure 4:
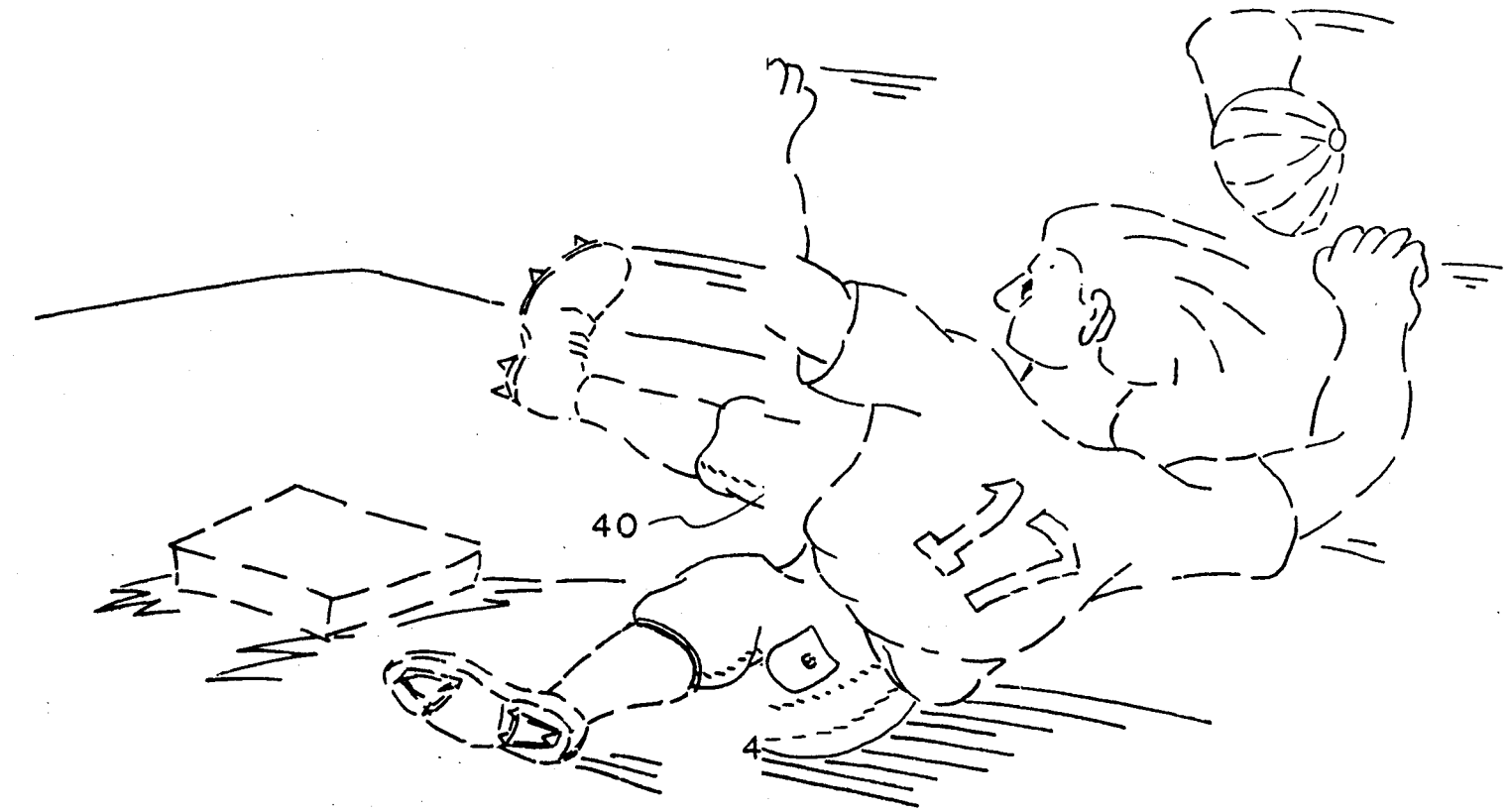
FIG. 4 shows a diagrammatic view of a player (shown in phantom) wearing an embodiment of the instant invention.
Figure 9:
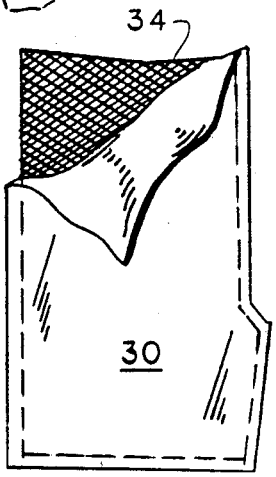

A sheet of foam rubber (or equivalent) padding 34, sized appropriately to encircle the outer one-half of the player's leg, is captured between the outermost and innermost layers. As seen in FIGS. 8 and 9, the inner lining 30 is made in slightly larger dimensions, of for instance length and width, than padding 34 so as to overlap the layer of padding. The layer of padding 34 can be made in a three-sixteenths inch (3/16ths in.) thickness, by any commercially-available processes, and the padding 34 and the inner lining 30 are stitched to the inside surface of the outer garment layer 22, 24 for comfort of the wearer. The outer layer and the inner layer capture the foam padding layer between them.

The outer layer 22, 24 of the garment is sized and cut according to patterns normally used and a left and a right half are joined together at the common seam, as is known in the industry. A two inch wide strip of elastic band material 38 is sewn, using the overlock stitch, into the waistband 23 of the garment and the pants can either be worn with or without a nylon zipper fly front 25 and one-half inch wide covering 27 (shown only in FIGS. 1 and 2). When the fly front style is used, fastening means, such as double snaps, or buttons 29, are employed to secure the front thereof and are attached to the waistband by means known in the art. All three embodiments can have hems 31 put in at the ends of the leg portions, and, additionally, with the long-legged version (FIGS. 1 to 4), one-quarter inch wide elastic bands 35 are sewn inside the hem.

Figure 1:
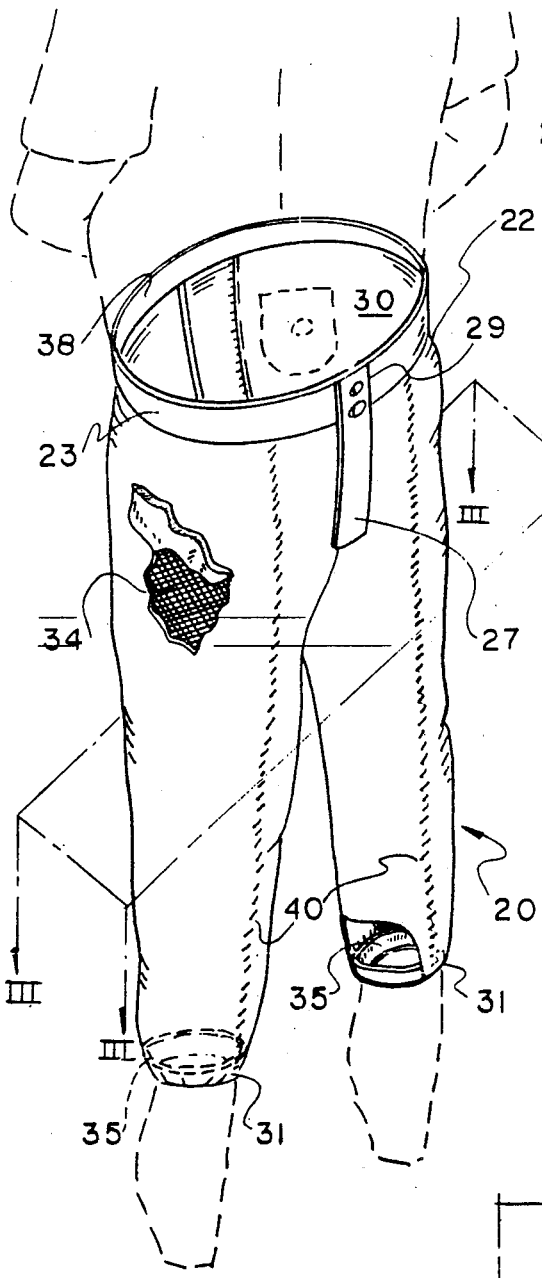
FIG. 1 shows a fragmentary, perspective view of the front of a player (shown in phantom) wearing an embodiment of the all-in-one slider sport pants of the present invention.
Figure 2:
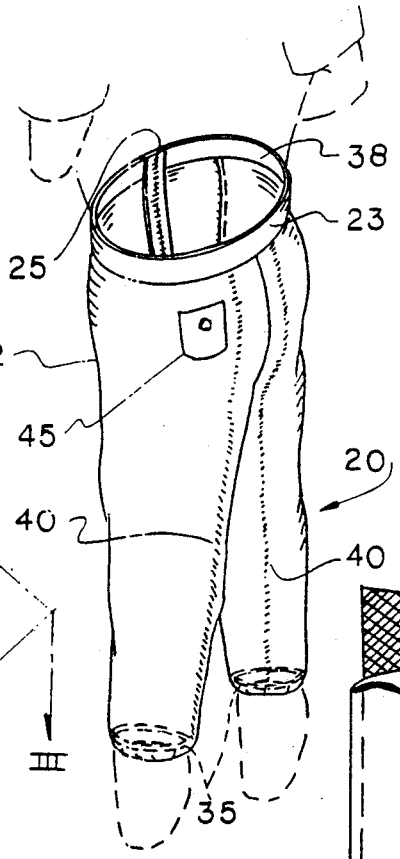
FIG. 2 shows a fragmentary, perspective view of the back of the player (shown in phantom) wearing the embodiment of the present invention shown in FIG. 1.

As can be seen in FIGS. 8 and 9, the inner two layers 30, 34 are cut in the same shapes with the lining being slightly larger, by approximately one sixteenth of an inch, than padding layer 34. These two layers are sewn onto the inner surface of the outer garment 22, 24, to extend approximately half-way therearound at the outer, circumferential half of each leg portion, using a zig-zag stitch to reduce any bothersome ridges or irritating stitching therealong. (FIGS. 1 and 5 show a small segment of the outer garment 22, 24 broken away for clarity only.) The two inner layers are also stitched to the waistband (as described above) and longitudinally-extending, zig-zag stitching 40, as it breaks through the front and back sides of both leg portions, further secures the two layers to the inside surface. An alternate embodiment of the sports pants can include a patch pocket 45 sewn directly below the waistband on either the left or right side (only left side shown in FIGS. 1 and 2).

What we claim is:

1. A utility garment for a sports player that protects the legs, hips and buttocks of the player from friction or contusion injuries caused when sliding into a base, comprising:

an outer garment layer, conforming substantially to the shape of trousers with waist, buttock, hip and leg portions, having waistband means for enclosing a player's waist;

padding layer means extending from approximately half-way to approximately three-quarters around the inner surface of said outer garment layer at the outer, circumferential half of each leg portion, substantially conforming, in shape, to the contour of the outer garment layer, and affixed to the inner surface of said outer garment layer; and, an inner layer lining, to be adjacent the player and substantially conforming, in peripheral shape, to the contour of said padding layer means, affixed along the periphery of said padding layer means and said inner lining to said outer garment layer.

2. A utility garment as described in claim 1 wherein said outer garment layer has legband means at the distil ends of the leg portions for enclosing the players legs.

3. A utility garment as described in claim 2 wherein said inner layer lining and said padding layer means are affixed to the inner surface of said outer garment layer by zig-zag stitching which forms longitudinal stitching along the outer surface of each leg portion.

4. A utility garment as described in claim 3 wherein said waistband means includes a band of elastic material of predetermined width sewn to the waist portion.

5. A utility garment as described in claim 4 wherein said waistband means includes contiguous end pieces fastened by adjustable closure means.

6. A utility garment as described in claim 5 wherein said adjustable closure means comprises a zipper.

7. A utility garment as described in claims 1 wherein said padding layer is a sheet of foam rubber of a thickness of approximately three-sixteenths (3/16ths) of an inch.

8. A utility garment as described in claim 6 wherein said padding layer is a sheet of foam rubber of a thickness of approximately three-sixteenths (3/16ths) of an inch.

9. A utility garment as described in claim 7 including pocket means attached to the outer surface of the outer garment layer below the waist portion.

10. A utility garment as described in claim 8 including pocket means attached to the outer surface of the outer garment layer below the waist portion.

* * * * *